US010774439B2

(12) United States Patent
Babcock

(10) Patent No.: US 10,774,439 B2
(45) Date of Patent: Sep. 15, 2020

(54) METHODS OF MONITORING A PLATING BATH

(71) Applicant: The Boeing Company, Chicago, IL (US)

(72) Inventor: Ed A. Babcock, Mesa, AZ (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 16/190,435

(22) Filed: Nov. 14, 2018

(65) Prior Publication Data

US 2020/0149182 A1 May 14, 2020

(51) Int. Cl.
*C25D 21/12* (2006.01)
*C25D 5/48* (2006.01)

(52) U.S. Cl.
CPC ..... *C25D 21/12* (2013.01); *C25D 5/48* (2013.01)

(58) Field of Classification Search
None
See application file for complete search history.

(56) References Cited

U.S. PATENT DOCUMENTS 8,177,953 B2 * 5/2012 Nardi ..... G01N 3/04 202/258
9,176,039 B2 11/2015 Tran et al.
2007/0284256 A1 * 12/2007 Piper ..... C25D 7/04 205/145
2012/0097101 A1 * 4/2012 Schwartz ..... C25D 17/00 118/696
2018/0282893 A1 * 10/2018 Yamasaki ..... C25D 21/12

OTHER PUBLICATIONS

ASTM E290-14 (Year: 2014).*
ASTM International; "Standard Test Method for Mechanical Hydrogen Embrittlement Evaluation of Plating/Coating Processes and Service Environments," Designation F519-17a; 19 pp.
Khare, Amit et al., "A Review on Failures of Industrial Components due to Hydrogen Embrittlement & Techniques for Damage Prevention," International Journal of Applied Engineering Research; vol. 12, No. 8 (2017); pp. 1784-1792.
MIA Metallurgical Associates, Inc., "Hydrogen Embrittlement—High Strength Steels Achilles Heel—Part 4," available online at http://metassoc.com/tag/hydrogen-embrittlement/; last visited Nov. 14, 2018; 6 pp.
The Elsmar Cove; Verification Test for Hydrogen De-embrittlement?; Online Forum available at https://elsmar.com/elsmarqualityforum/threads/verification-test-for-hydrogen-de-embrittlement.31635/; last visited Nov. 14, 2018; 5 pp.

* cited by examiner

*Primary Examiner* — Brian W Cohen
(74) *Attorney, Agent, or Firm* — Armstrong Teasdale LLP

(57) ABSTRACT

A method of monitoring a plating bath, the method including receiving a plurality of plated test specimens that are each plated in different batches within the plating bath. The different batches are processed in a batch sequence, and at least one plated test specimen is plated in each batch processed in the plating bath. The method also includes performing a load test on each plated test specimen, wherein the load tests are initiated in a load test sequence that corresponds to the batch sequence, and determining a health status of the plating bath based on results of the load tests.

17 Claims, 4 Drawing Sheets

METHODS OF MONITORING A PLATING BATH

FIELD

The field of the present disclosure relates generally to hydrogen embrittlement, and more specifically, to methods of monitoring a health status of a plating bath.

BACKGROUND

Hydrogen embrittlement refers to a process that causes a metal or metal alloy, such as steel, to become brittle and susceptible to fracture when exposed to a quantity of hydrogen and subjected to a load. Hydrogen embrittlement generally occurs when hydrogen atoms diffuse through the crystalline structure (i.e., matrix) of a metal resulting in an increased pressure within the metal matrix. The increased pressure can adversely affect characteristics of metal, such as ductility and tensile strength. At least some known sources of hydrogen atoms are electroplating solutions, pickling solutions, phosphating solutions, paint-stripping solutions, cleaning solutions, and the like.

In at least some known electroplating processes, a metal substrate cathode and a plating material anode are submerged in a plating bath containing plating solution. Electric current is applied to the anode and cathode to deposit a layer of plating material on the surface of the metal substrate via the plating solution. After a desired amount of plating material has been deposited on the metal substrate, the substrate may then be heated to facilitate removing hydrogen trapped in the steel substrate beneath the plating material. Metal substrates also generally have organic surface contaminants, which if not properly cleaned prior to plating, may contaminate the plating solution. As such, prolonged use of the plating solution may affect the quality of the plated sample due to the contaminants. For example, an increased contaminant concentration in the plating solution may decrease the porosity of the plating layer, thereby limiting the amount of hydrogen removed from plated metals during the post-deposition heating process.

One known method of determining the porosity level of a plating solution involves periodically performing sustained load testing on select samples plated in different batches of the plating solution. Performance of sustained load testing requires the use of specialized test frames that are limited in number worldwide such that samples are typically plated and then shipped to a testing facility remote from the plating site. Sustained load testing also takes several days to complete. As such, there is significant delay between completion of a plating process and completion of a load test for a particular sample. The delay makes it difficult to detect contamination of the plating solution in a timely manner.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

BRIEF DESCRIPTION

In one aspect, a method of monitoring a plating bath is provided. The method includes receiving a plurality of plated test specimens that are each plated in different batches within the plating bath, wherein the different batches are processed in a batch sequence, and wherein at least one plated test specimen is plated in each batch processed in the plating bath. The method also includes performing, at the same facility as the plating bath, a load test on each plated test specimen, wherein the load tests are initiated in a load test sequence that corresponds to the batch sequence, and determining a health status of the plating bath based on results of the load tests.

In another aspect, a method of monitoring a plating bath is provided. The method includes (a) plating a plated test specimen in a batch within the plating bath, (b) plating a plated production part in the batch within the plating bath with the plated test specimen, (c) performing, at the same facility as the plating bath, a load test on the plated test specimen with a test fixture, wherein the plating bath and the test fixture are at the same location, and (d) determining a health status of the plating bath based on a result of the load test.

In yet another aspect, a method of monitoring a plating bath is provided. The method includes receiving a plurality of plated test specimens that are each plated in different batches within the plating bath, wherein the different batches are processed in a batch sequence, and wherein at least one plated test specimen is plated in each batch processed in the plating bath. The method also includes performing, at the same facility as the plating bath, a load test on each plated test specimen as received in the batch sequence, wherein a load test duration is greater than a plating batch duration, and wherein the load test is performed on each plated test specimen with a different test fixture, such that a plurality of load tests are performed simultaneously. The method further includes determining a health status of the plating bath based on results of the plurality of load tests.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

The implementations described herein relate to methods of monitoring a health status of a plating bath. The methods described herein include plating a test specimen along with a production part in every batch processed in the plating bath. A load test is performed on the plated test specimen plated in each batch, and the load tests are initiated in a sequence that corresponds to an order in which the test specimens are plated in the plating bath. As such, the results of the load tests are received in the sequence, which enables the health status of the plating bath to be tracked and subsequently correlated to a health status of production parts plated in associated batches. For example, if a plated test specimen plated in a predetermined batch fails its load test, processing in the plating bath is stopped, and production parts plated in the predetermined batch and in batches processed thereafter are quarantined as having been potentially plated in a contaminated plating bath. In addition, the load tests are initiated as soon as possible after a test specimen has been plated, and the load test fixtures are located at the plating bath facility such that load tests are performed at the same facility as the plating bath, to facilitate reducing an amount of delay between plating completion and load test initiation of a particular plated test specimen. As such, in facilities in which multiple batches are processed in the plating bath in an intervening period between initiation and completion of a load test that produces a failed result, the reduction in delay facilitates providing timely detection of a contaminated plating bath, thereby reducing the production of potentially defective parts in the bath.

As used herein, an element or step recited in the singular and preceded with the word "a" or "an" should be understood as not excluding plural elements or steps, unless such exclusion is explicitly recited. Furthermore, references to "exemplary implementation" or "one implementation" of the present disclosure are not intended to be interpreted as excluding the existence of additional implementations that also incorporate the recited features.

Figure 1:
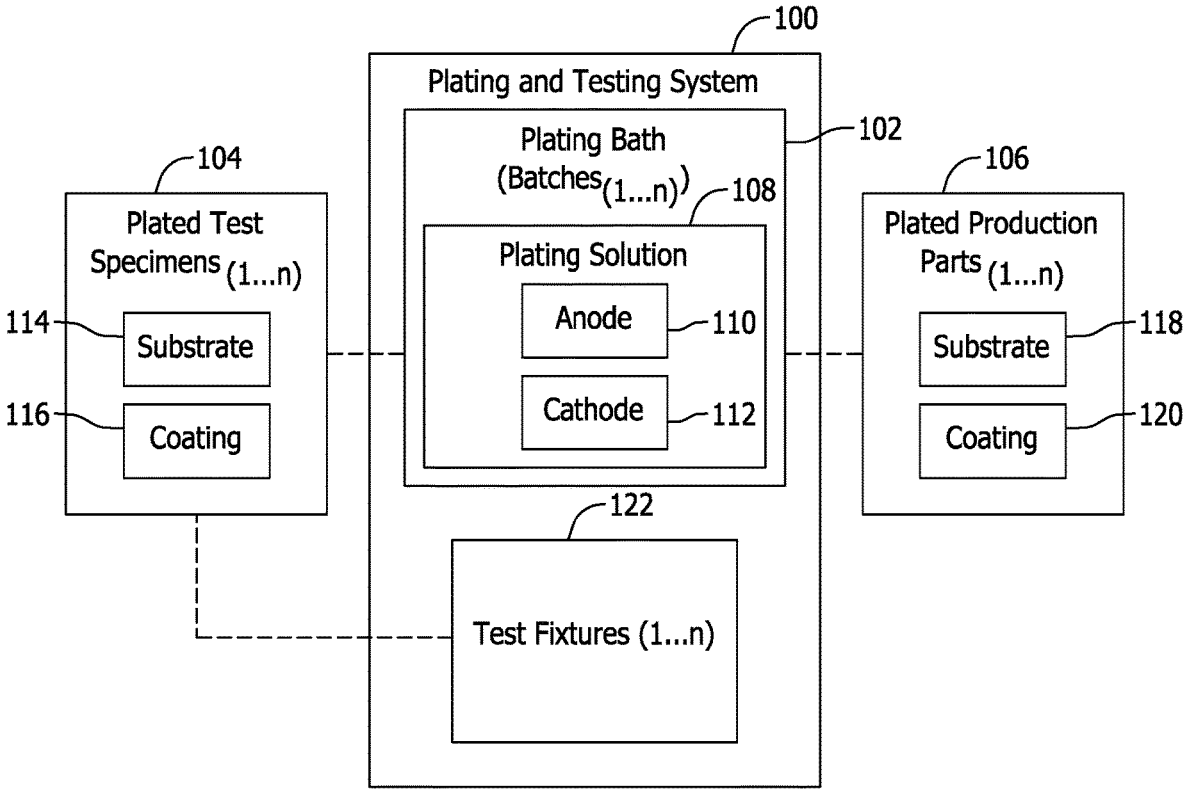
FIG. 1 is a block diagram of an example plating and testing system.

FIG. 1 is a block diagram of an example plating and testing system 100. In the example implementation, plating and testing system 100 includes a plating bath 102 configured to process plated test specimens 104 and plated production parts 106 therein in one or more batches. Plating bath 102 includes plating solution 108, and an anode 110 and a cathode 112 submerged within plating solution 108. Plated test specimens 104 include a substrate 114 and a coating 116 formed on substrate 114, and plated production parts 106 include a substrate 118 and a coating 120 formed on substrate 118. Coatings 116 and 120 are formed from the material of anode 110, which is deposited on substrates 114 and 118 during an electroplating process, for example.

Plating bath 102 is sized for plating at least one plated test specimen 104 and at least one plated production part 106 in each batch processed therein. That is, one or more plated production parts 106 are plated per batch, and at least one plated test specimen 104 is plated with the one or more plated production parts 106 in each batch. As such, plating at least one plated test specimen 104 in each batch processed in plating bath 102 facilitates monitoring the health status of plating bath 102 on a continuous basis.

Plating and testing system 100 also includes a plurality of test fixtures 122 for performing load tests on plated test specimens 104. For example, the test fixtures 122 may perform a load test by applying a bending load or a tensile load on plated test specimens 104 in accordance with the ASTM International F519-Standard Test Method for Mechanical Hydrogen Embrittlement Evaluation of Plating/Coating Processes and Service Environments methodology. As such, in the example implementation, plated test specimens 104 are notched test specimens, where plated test specimens 104 are threadably, or non-threadably, engaged with test fixtures 122, and test fixtures 122 are self-loading test fixtures, all in accordance with ASTM F519.

In an aspect of the present disclosure, the load test of plated test specimens 104 may require a duration of time of 200 hours up to 10 days, for example. The exemplary load test fixture 122, which threadably, or non-threadably, engages a notched plated test specimen 104 for applying a load on the plated test specimen in accordance with ASTM International F519, is significantly smaller than large industrial load test equipment used at specialized testing laboratories. Accordingly, the load test fixture 122, which tests at least one plated test specimen that was plated along with production parts in a predetermined batch processed in the plating bath, may be co-located with the plurality of plated production parts from the predetermined batch at the location of the facility of the plating bath where the batch was plated. Accordingly, if the plated test specimen plated in the predetermined batch fails its load test, the production parts plated in the predetermined batch that are co-located with the load test fixture 122 are readily quarantined, and identified as having been potentially plated in a contaminated plating bath.

In another aspect of the present disclosure, the exemplary load test fixture 122, which threadably, or non-threadably, engages a notched plated test specimen 104 for applying a load on the plated test specimen in accordance with ASTM International F519, may be assigned an inventory location identification (ID) associated with the inventory location for the production parts in a predetermined batch that was plated in the plating bath. At the location of the facility of the plating bath, the load test fixture 122 performs the load test of at least one plated test specimen that was plated along with production parts in the predetermined batch, and is assigned an inventory location ID associated with the inventory location for the production parts plated in the predetermined batch from which the plated test specimen came. The inventory of production parts plated in the predetermined batch are withheld from use in production until completion of the load test of the plated test specimen associated with the predetermined batch. Accordingly, if the plated test specimen of a predetermined batch fails the load test on the load test fixture 122 assigned the inventory location ID associated with the inventory location for the predetermined batch of production parts, the inventory location ID readily identifies the inventory location at which to quarantine the production parts plated in the predetermined batch that have been potentially plated in a contaminated plating bath. The inventory location may be at a production facility that is remote from the plating bath facility, where the predetermined batch of production parts in the inventory location at the production facility may be withheld from use in production until completion of the load test of the plated test specimen associated with the predetermined batch. Alternatively, the inventory location may be located at the plating bath facility such that the predetermined batch of production parts are quarantined at the plating bath facility.

Figure 2:
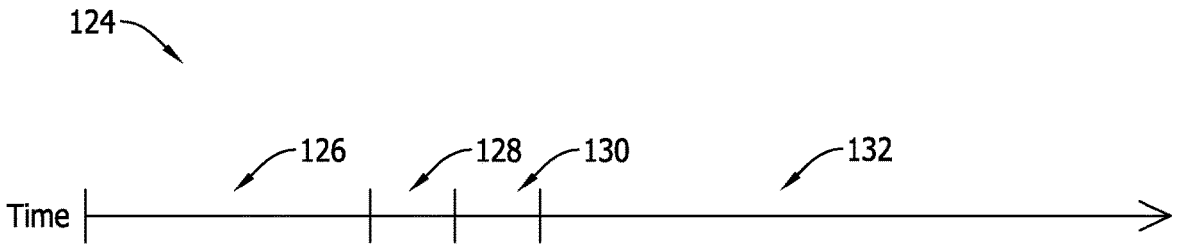
FIG. 2 is a timeline of an example production and testing schedule for a plated test specimen.

FIG. 2 is a timeline of an example production and testing schedule 124 for a plated test specimen 104 (shown in FIG. 1). In the example implementation, production and testing schedule 124 includes a plating cycle 126 defined by a first duration, a heating cycle 128 defined by a second duration, a cooling cycle 130 defined by a third duration, and a testing cycle 132 defined by a fourth duration. In plating cycle 126, plated test specimen 104 is plated in plating bath 102 to form coating 116 on substrate 114 (both shown in FIG. 1). Plated test specimen 104 is then heated to facilitate hydrogen removal from substrate 114, and cooled to enable testing cycle 132 to be initiated and a load test to be performed. Heating cycle 128 includes heating plated test specimen 104 at a first predetermined temperature. Cooling cycle 130 includes cooling plated test specimen 104 to a second predetermined temperature less than the first predetermined temperature. Plated test specimen 104 may be cooled with or without an active cooling system. Results of the load test are obtained after the fourth duration has elapsed. In one implementation, the fourth duration is up to about 200 hours, as illustrated in FIG. 3.

Figure 3:
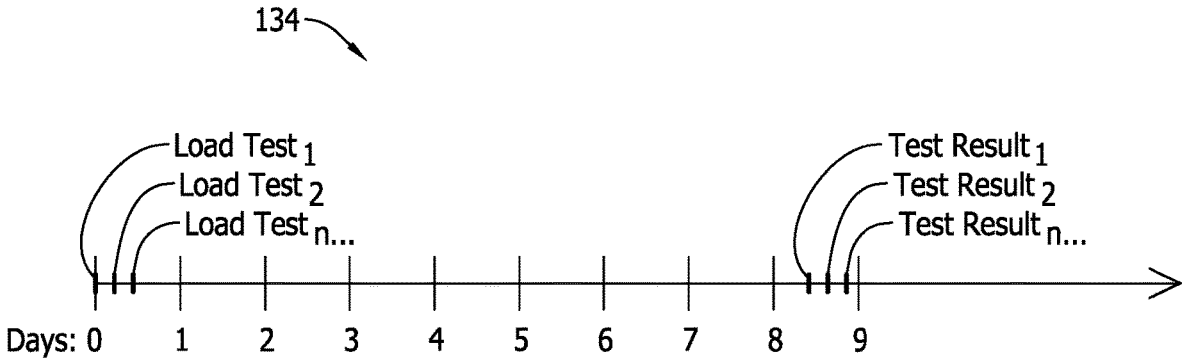
FIG. 3 is a timeline of an example testing schedule that may be used by the plating and testing system shown in FIG. 1.

FIG. 3 is a timeline of an example testing schedule 134 that may be used by plating and testing system 100 (shown in FIG. 1). In the example implementation, a series of load tests are performed on plated test specimens 104 (shown in FIG. 1). The plated test specimens 104 are each plated in different batches within plating bath 102 (shown in FIG. 1), wherein the different batches are processed in a batch sequence. Likewise, the load tests are performed in a load test sequence that corresponds to the batch sequence.

For example, in one implementation, the batch sequence is defined by processing a first batch, a second batch, and a third batch in plating bath 102 sequentially. As such, the load test sequence corresponds to the batch sequence in that the load test sequence is defined by initiating a first load test, a second load test, and a third load test using test fixtures 122 (shown in FIG. 1) sequentially. The first load test is performed on plated test specimen 104 plated in the first batch, the second load test is performed on plated test specimen 104 plated in the second batch, and the third load test is performed on plated test specimen 104 plated in the third batch. The first, second, and third load tests are each performed for a predetermined duration, such as the fourth duration noted above. As such, results of the loads tests are received in a sequence corresponding to the load test sequence, which facilitates tracking the production of potentially defective plated production parts 106 (shown in FIG. 1) in plating bath 102.

For example, if it is determined that plated test specimen 104 plated in the first batch has failed its load test, the results of the load test are used to determine the health status of plating bath 102 at times corresponding to when certain batches are processed therein. The health status of plating bath 102 is determined to be normal if plated test specimen 104 passes the load test, and is determined to be abnormal if plated test specimen 104 fails the load test. If plated test specimen 104 plated in the first batch fails its load test, the failed test results may be correlated to the health status of plating bath 102 at a time corresponding to the first batch, and at a time corresponding to batches processed after the first batch. The health status of plating bath 102 may then be correlated to a health status of plated production parts 106 plated in plating bath 102.

For example, upon receiving the results of the failed load test of plated test specimen 104 plated in the first batch, plating in plating bath 102 is stopped and all plated production parts 106 plated in the first batch and in batches processed thereafter are quarantined. An investigation may then be performed to validate the results of the failed load test. In one implementation, a first plated test specimen and a second plated test specimen are plated in each batch, and load test results for the second plated test specimen are evaluated if the first plated test specimen fails its load test. Alternatively, if plated test specimen 104 plated in the first batch fails its load test, the load test result of plated test specimen 104 plated in the second batch is evaluated to validate the results of the failed load test.

The health status of plated production parts 106 may either be normal or abnormal. If the results of the failed load test are validated, the health status of plated production parts 106 plated in the first batch and in batches processed thereafter is determined to be abnormal. As such, it is determined that the plated production parts 106 may be defective and/or unusable for their intended purpose.

In some implementations, plating bath 102 is used continuously or semi-continuously such that more than one batch is processed in plating bath 102 per day. Accordingly, more than one load test may be initiated per day to facilitate continuous or semi-continuous monitoring of plating bath 102. For example, as illustrated in FIG. 3, the second load test is initiated after the first load test is initiated, but before the first load test is complete. In addition, the load tests for plated test specimens 104 are initiated as soon as possible after plating is completed to facilitate reducing delay between plating completion and load test completion. For example, in one implementation, the load test of a particular plated test specimen 104 is initiated immediately after cooling cycle 130 (shown in FIG. 2) is complete and plated test specimen 104 is at the second predetermined temperature. That is, the first load test is initiated at a first interval after processing of the first batch is initiated. The first interval is approximately equal to a sum of the first duration, the second duration, and the third duration. In addition, the second load test is initiated at a second interval after the first load test is initiated. The second interval is approximately equal to the first duration. As such, delay in receiving the load test results is reduced.

The delay is further reduced by performing the load tests with test fixtures 122 positioned at the same location as plating bath 102. As such, the load tests may be performed without having to ship plated test specimens 104 offsite, thereby eliminating shipping delay and reducing the delay between plating completion and load test completion.

Figure 4:
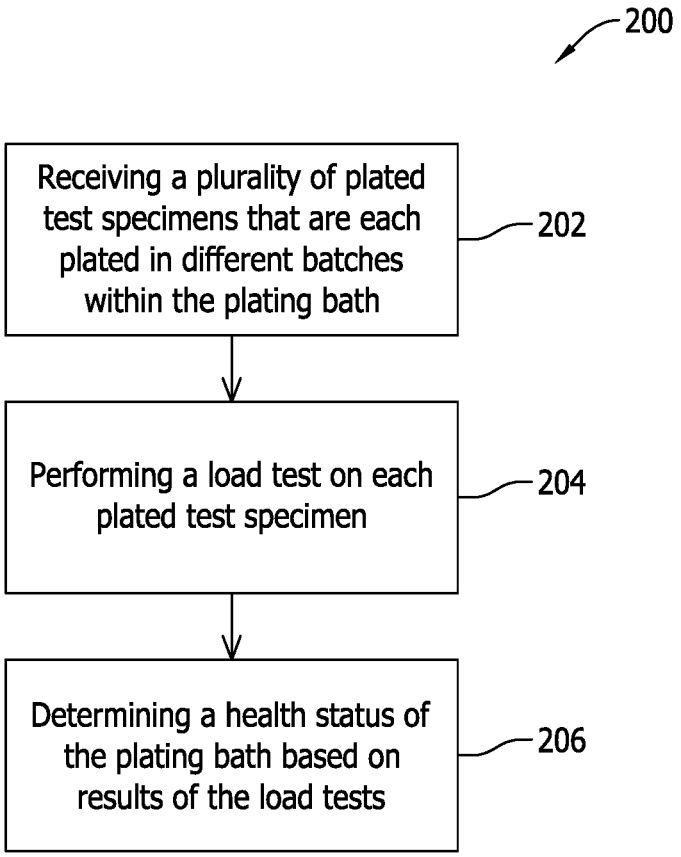
FIG. 4 is a flow diagram illustrating an example method of monitoring a plating bath.

FIG. 4 is a flow diagram illustrating an example method 200 of monitoring a plating bath. Method 200 includes receiving 202 a plurality of plated test specimens that are each plated in different batches within the plating bath. The different batches are processed in a batch sequence, and at least one plated test specimen is plated in each batch processed in the plating bath. Method 200 also includes performing 204, at the same facility as the plating bath, a load test on each plated test specimen. The load tests are initiated in a load test sequence that corresponds to the batch sequence. In addition, in one implementation, a load test duration is greater than a plating batch duration, and the load test is performed on each plated test specimen with a different test fixture, such that a plurality of load tests are performed simultaneously. Method 200 further includes determining 206 a health status of the plating bath based on results of the load tests.

Figure 5:
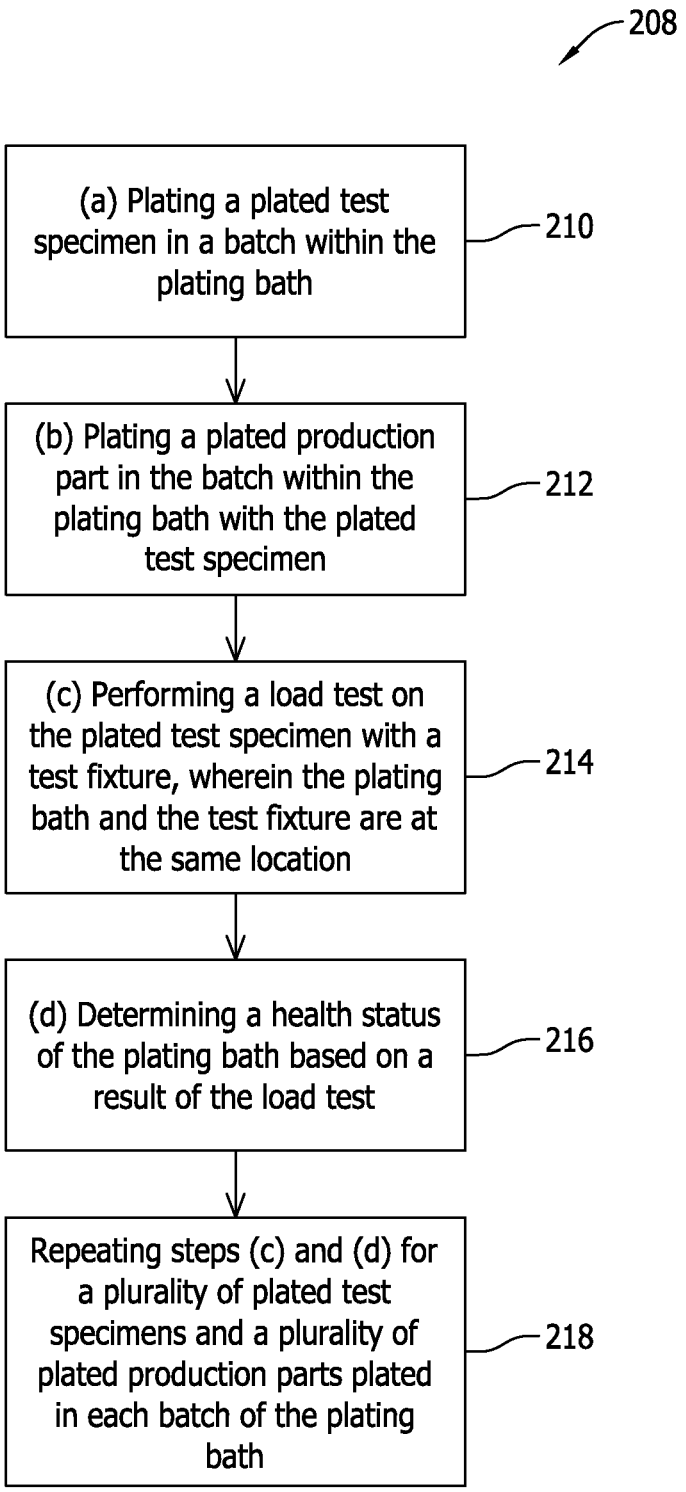
FIG. 5 is a flow diagram illustrating an alternative method of monitoring a plating bath.

FIG. 5 is a flow diagram illustrating an alternative method 208 of monitoring a plating bath. Method 208 includes (a) plating 210 a plated test specimen in a batch within the plating bath; (b) plating 212 a plated production part in the batch within the plating bath with the plated test specimen; (c) performing 214 a load test on the plated test specimen with a test fixture, wherein the plating bath and the test fixture are at the same location; and (d) determining 216 a health status of the plating bath based on a result of the load test. Steps (c) and (d) are repeated 218 for a plurality of plated test specimens and a plurality of plated production parts plated in each batch of the plating bath.

This written description uses examples to disclose various implementations, including the best mode, and also to enable any person skilled in the art to practice the various implementations, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of monitoring a plating bath, the method comprising:

plating at least one plated production part in each batch processed in the plating bath, wherein the at least one plated production part is plated with at least one plated test specimen plated in each batch of different batches;

receiving a plurality of plated test specimens that are each plated in different batches within the plating bath, wherein the different batches are processed in a batch sequence, and wherein the at least one plated test specimen is plated in each batch processed in the plating bath;

performing, at the same facility as the plating bath, a load test on each plated test specimen, wherein the load tests are initiated in a load test sequence that corresponds to the batch sequence; and determining a health status of the plating bath based on results of the load tests, wherein performing a load test includes initiating, with a first test fixture, a first load test on a first plated test specimen plated in a first batch; and initiating, with a second test fixture, a second load test on a second plated test specimen plated in a second batch processed after the first batch, wherein the second load test is initiated before the first load test is complete, and wherein determining a health status includes determining that a first plated test specimen has failed the load test, wherein the first plated test specimen is plated in a predetermined batch; and correlating the health status of the plating bath to a health status of the at least one plated production part plated in the predetermined batch, and plated in the batches processed after the predetermined batch.

2. The method in accordance with claim 1, wherein each batch is processed for a first duration, and wherein each plated test specimen is heated for a second duration and cooled for a third duration after removal from the plating bath, wherein initiating the first load test comprises initiating the first load test at a first interval after processing of the first batch is initiated, wherein the first interval is approximately equal to a sum of the first duration, the second duration, and the third duration.

3. The method in accordance with claim 2, wherein initiating a second load test comprises initiating the second load test at a second interval after the first load test is initiated, wherein the second interval is approximately equal to the first duration.

4. The method in accordance with claim 1 further comprising receiving results of the load tests for the plurality of plated test specimens in a sequence corresponding to the load test sequence.

5. The method in accordance with claim 1, wherein performing a load test comprises performing the load test for a duration of at least about 200 hours.

6. A method of monitoring a plating bath, the method comprising:

plating a first plated test specimen in a first batch within the plating bath;

plating a first plated production part in the first batch within the plating bath with the first plated test specimen;

performing, at the same facility as the plating bath, a load test on the first plated test specimen with a test fixture, wherein the plating bath and the test fixture are at the same location;

plating at least one additional plated test specimen and at least one additional plated production part in each additional batch processed after the first batch within the plating bath; and determining a health status of the plating bath, and of the plated production parts processed in and after the first batch, based on a result of the load test of the first plated test specimen.

7. The method in accordance with claim 6 further comprising performing a load test on the at least one test specimen processed in each batch, thereby defining a plurality of load tests and a plurality of plated test specimens, wherein the plurality of load tests are performed on the plurality of plated test specimens with different test fixtures.

8. The method in accordance with claim 6, wherein performing the load test comprises performing the load test with a self-loading test fixture in accordance with ASTM F519.

9. The method in accordance with claim 6, wherein plating the first plated test specimen comprises inserting a test specimen in the plating bath, wherein the test specimen is a notched test specimen in accordance with ASTM F519.

10. The method in accordance with claim 6, wherein performing the load test comprises engaging the first plated test specimen with the test fixture.

11. The method in accordance with claim 6, wherein performing the load test comprises performing the load test for a duration of at least about 200 hours and applying a bending load or a tensile load on the first plated test specimen.

12. The method in accordance with claim 6, wherein the test fixture that performs the load test of the first plated test specimen that was plated along with the first plated production part in a predetermined batch is co-located with a plurality of plated production parts from the predetermined batch at a location of the facility.

13. The method in accordance with claim 6, wherein the test fixture that performs the load test of the first plated test specimen that was plated along with the first plated production part in a predetermined batch is assigned an inventory location ID associated with an inventory location for the first plated production part plated in the predetermined batch.

14. The method in accordance with claim 6 wherein performing a load test comprises:

initiating, with a first test fixture, a first load test on the first plated test specimen plated in the first batch; and initiating, with a second test fixture, a second load test on the at least one additional plated test specimen plated in the additional batch processed after the first batch, wherein the second load test is initiated before the first load test is complete.

15. The method in accordance with claim 14, wherein performing the first load test comprises engaging the first plated test specimen with the first test fixture, and performing the second load test comprises engaging the second plated test specimen with the second test fixture.

16. The method in accordance with claim 6 wherein performing a load test comprises:

determining that the first plated test specimen has failed the load test, wherein the first plated test specimen is plated in the first batch; and determining the health status of the plating bath at a time corresponding to the first batch, and at a time corresponding to additional batches processed after the first batch.

17. The method in accordance with claim 6 wherein performing a load test comprises:

determining that the first plated test specimen has failed the load test, wherein the first plated test specimen is plated in the first batch, wherein the first plated production part is plated with the first plated test specimen plated in the first batch; and correlating the health status of the plating bath to a health status of the first plated production part plated in the first batch, and to a health status of the at least one additional plated production part plated in the additional batches processed after the first batch.

* * * * *